United States Patent [19]

Van Marcke

[11] Patent Number: 4,941,219

[45] Date of Patent: Jul. 17, 1990

[54] BODY HEAT RESPONSIVE VALVE CONTROL APPARATUS

[75] Inventor: Karel C. Van Marcke, Kruishoutem, Belgium

[73] Assignee: International Sanitary Ware Manufacturing Cy, S.A., Kruishoutem, Belgium

[21] Appl. No.: 419,315

[22] Filed: Oct. 10, 1989

[51] Int. Cl.[5] ..... E03C 1/05; E03C 1/00

[52] U.S. Cl. ..... 4/623; 4/304; 4/DIG. 3; 251/129.04

[58] Field of Search ..... 4/623, 302, 304, 305, 4/313, DIG. 3; 251/129.04, 129.03, 129.02; 137/607

[56] References Cited

U.S. PATENT DOCUMENTS

| | | | |
|---|---|---|---|
| 3,551,919 | 1/1971 | Forbes | 4/623 |
| 3,576,277 | 4/1971 | Blackmon | 222/1 |
| 3,588,038 | 6/1971 | Tanaka | 251/129 |
| 4,520,516 | 6/1985 | Parsons | 4/623 |
| 4,598,726 | 7/1986 | Pepper | 137/1 |
| 4,651,777 | 3/1987 | Hardman | 137/487.5 |
| 4,681,141 | 7/1987 | Wang | 137/607 |
| 4,682,628 | 7/1987 | Hill | 137/624 |
| 4,688,277 | 8/1987 | Kakinoki et al. | 4/623 |
| 4,709,728 | 12/1987 | Ying-Chung | 137/636.4 |
| 4,735,357 | 4/1988 | Gregory et al. | 236/93 |
| 4,741,363 | 5/1988 | Hu | 137/607 |
| 4,742,583 | 5/1988 | Yoshida | 4/623 X |
| 4,762,273 | 8/1988 | Gregory et al. | 236/93 |
| 4,823,414 | 4/1989 | Piersimoni et al. | 4/623 |
| 4,826,129 | 5/1989 | Fong et al. | 251/129.04 |
| 4,838,310 | 6/1989 | Scott et al. | 251/129.04 X |
| 4,872,485 | 10/1989 | Lowerty, Jr. | 251/129.04 X |
| 4,894,874 | 1/1990 | Wilson | 4/623 |

*Primary Examiner*—Henry K. Artis

*Attorney, Agent, or Firm*—Cahill, Sutton & Thomas

[57] ABSTRACT

A low voltage battery energized passive detection system generates a control signal in response to radiated heat from a human body part to open a solenoid operated valve for a predetermined limited time period. In anticipation of a reduction of available DC power, voltage level sensing circuitry disables the valve in the closed position to prevent the valve from remaining in the open position due to an insufficiency of DC power to effect closure of the valve.

20 Claims, 8 Drawing Sheets

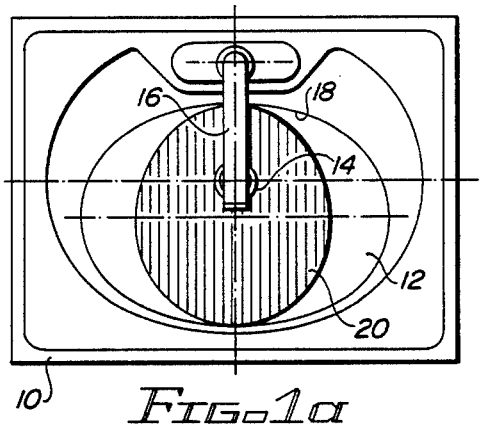
FIG. 1a
FIG. 1b
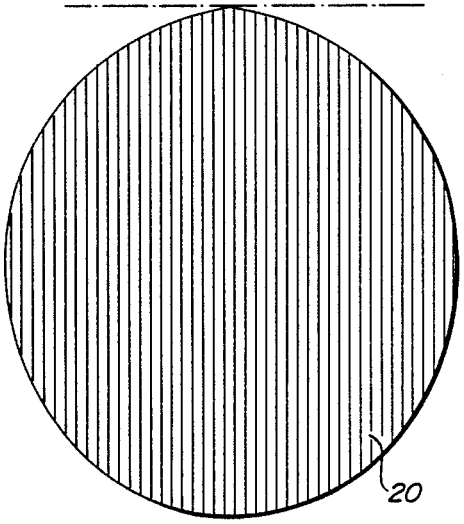
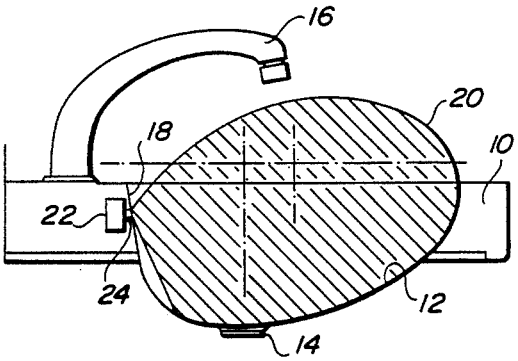
FIG. 2a
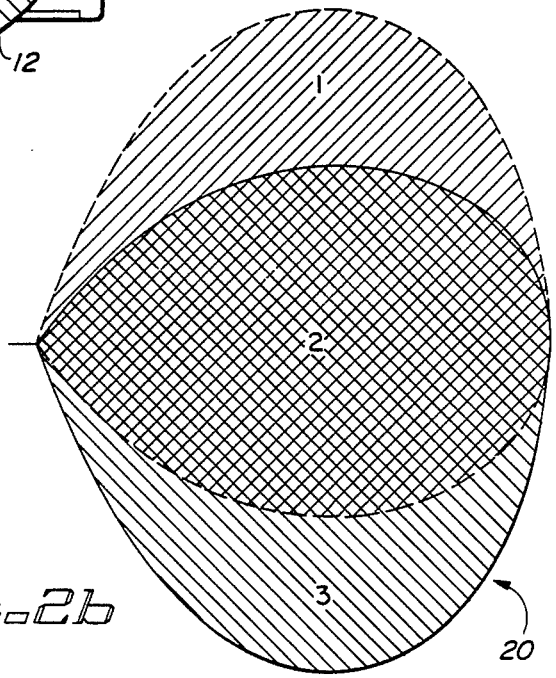
FIG. 2b

| VALVE | COLOR | DEF |
|---|---|---|
| 3 | GREEN | SP1 |
| 2 | WHITE | SP3 |
| 1 | BROWN | SP2 |

CONNECTION TO VALVE CABLE TYPE 3 X 0.25mm

BODY HEAT RESPONSIVE VALVE CONTROL APPARATUS

BACKGROUND OF THE INVENTION

1. Field of the Invention

The present invention relates to control systems and, more particularly, to low DC voltage detection systems responsive to radiated body heat for operating fluid flow valves.

2. Description of the Prior Art

Single or multi user wash basins used in industrial or commercial environments provide a source of water on demand for cleansing a user's hands, face and other body parts. Water flow valve actuating mechanisms are often manually or foot operated lever type devices to permit relative ease of use. The manually operated lever type devices may become soiled or otherwise damaged due to dirt and other contamination present on a user's hands prior to washing. The foot operated lever type devices are often subjected to abuse.

To avoid the requirements for having a user physically actuate a valve in order to cause water flow at a wash basin, various sensors have been developed and incorporated with valve actuating mechanisms to sense the presence of a user at a wash basin. Actuating apparatus of this type have included devices for generating ultrasonic energy focused upon a detector; upon a change in the energy detected due to the presence of a user, a signal may be generated for actuating a water flow valve. In one water faucet device, the faucet is rotatable to permit automatic water flow actuation or require manual valve control as a function of the rotational position of the faucet. Various devices have been developed which include a light emitter with a corresponding detector. Upon interruption of the light path by a wash basin user, actuation of a water flow valve will occur. Audio responsive detectors for actuating water flow valves associated with water basins and the like have been developed. Infrared detector systems include a generator for generating a source of infrared energy and a detector responsive thereto. Upon interruption of the infrared energy by a user, circuitry is energized for actuating a water flow valve. Several devices have also been developed for sensing the radiant energy of a human body part and actuating a water flow valve upon such sensing.

A common characteristic of prior art related devices for sensing the presence of a user and actuating a water flow valve is that such systems are active systems. That is, a signal generator is provided with a corresponding receiver. A change in signal intensity sensed by the receiver related circuitry and in response to the presence of a user, is detected and serves as a triggering signal for actuating a valve. The requirement for transmission of a signal, in combination with signal detection circuitry, imposes a requirement for a relatively substantial power supply. Such power supply requirements in essence negate the use of low voltage small capacity batteries as the power supply.

SUMMARY OF THE INVENTION

A low voltage battery energized passive detection system generates a control signal in response to radiated heat from a human body to open a solenoid operated fluid flow valve for a limited time period. The configuration of the sensor in combination with its placement within a wash basin establishes the configuration of the effective detection field to eliminate false signals. A multi position adjustment capability will accommodate changes in ambient temperature and detection signal strength requirements. To avoid the possibility of the valve remaining open due to insufficient electrical power to effect closure of the valve, a fail safe circuit will close and disable the valve in the closed position when the voltage of the power supply drops below a predetermined value.

It is therefore a primary object of the present invention to provide a passive detection system for detecting the presence of body heat within a defined detection field.

Another object of the present invention is to provide an automatically operated water basin for sensing the presence of body heat within a detection field.

Yet another object of the present invention is to provide a low DC power detection system responsive to the presence of a human body part for controlling actuation of water flow in a wash basin.

Yet another object of the present invention is to provide a flow control system for a wash basin which automatically terminates further flow upon sensing a reduced voltage power supply.

A further object of the present invention is to provide a water flow control system for wash basins having low electrical power drain and operable for an extended period of time by a low voltage low power battery source.

A still further object of the present invention is to provide a method for controlling water flow in a wash basin with a passive detection system responsive to the presence of human body heat within a detection field.

A yet further object of the present invention is to provide a method responsive to the presence of body heat for controlling the flow of water in a wash basin, for sensing a low voltage at the electrical power supply and for automatically terminating further water flow.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which:

FIG. 1*a* illustrates a representative wash basin having superimposed therein the horizontal detection field;

FIG. 1*b* is a representation of the horizontal detection field;

FIG. 2*a* is a partial cross sectional view of the wash basin and showing the vertical detection field therein;

FIG. 2*b* illustrates the vertically reduced detection field within the wash basin;

DESCRIPTION OF THE PREFERRED EMBODIMENT

Figure 3:
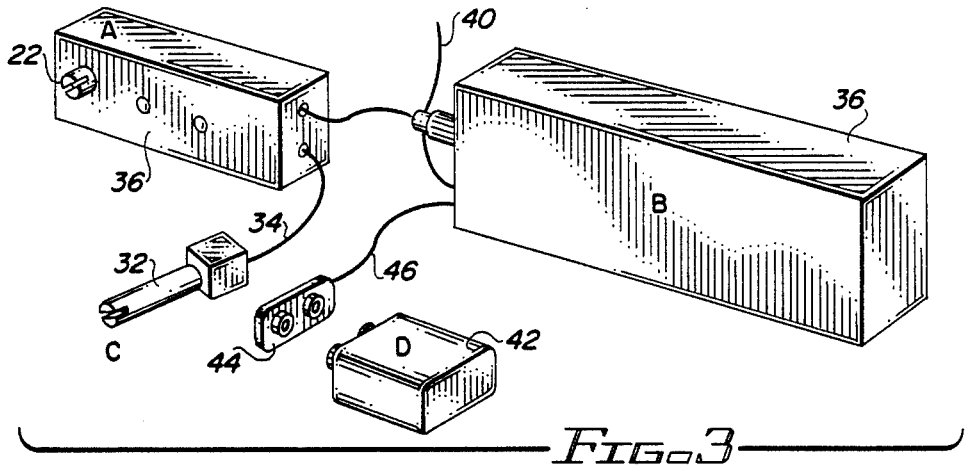
FIG. 3 illustrates the components for implementing the detection apparatus.
Figure 7:
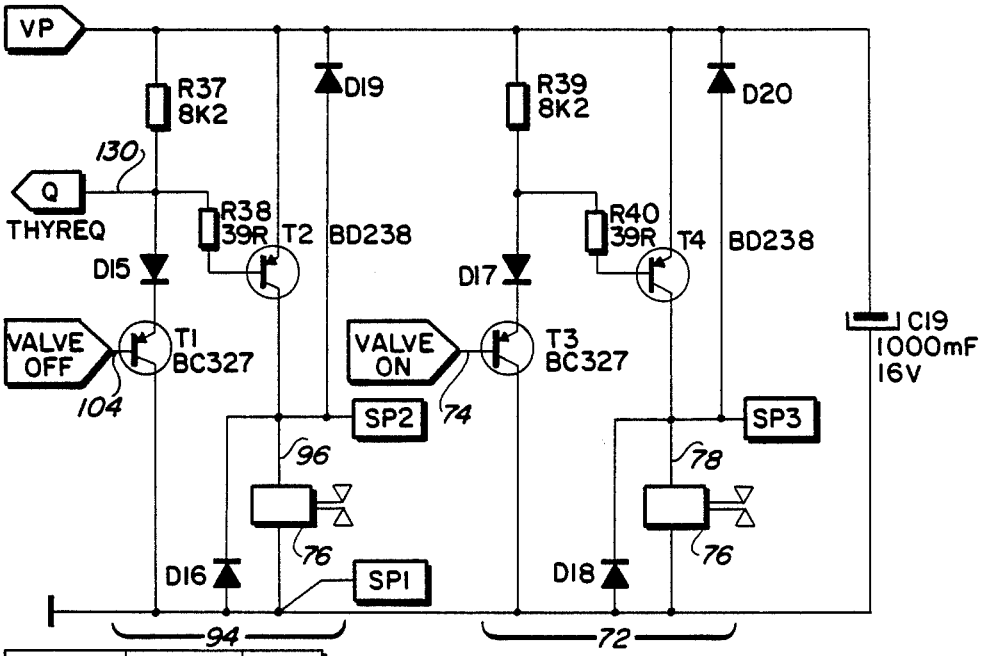
FIG. 7 illustrates the power output circuit of the detection system.

Public wash basins of the type used predominantly in various industrial and commercial establishments require manipulation of knobs, handles or push buttons to bring about water flow. Often, each of a hot and cold water tap must be adjusted to obtain a satisfactory temperature of the outflowing water. Such ongoing contact by dirty and/or contaminated hands promotes spread of bacteria and viruses due to the final manual contact after one's hands have been washed. The transfer of bacteria and viruses will result in the spread of disease. Where such diseases are life threatening or permanently disabling, the risks of using public wash basins become intolerable.

Preferably, the act of washing one's hands or face in a wash basin available to the public should not require physical contact with any part of the wash basin or associated implements. Apparatus for automatically discharging water should discharge such water at a preset temperature and for a period of time sufficient only to complete a washing in order to conserve water. The operative elements should be actuated as a function of the proximity of the user's hands or body and means should be employed to eliminate or prevent false actuation.

Any electrically energized components must be of sufficiently low voltage and power level to eliminate any electrical hazard. As many washing facilities are remote from a ready source of electrical power, the electrical power source for the actuating unit should be a battery. To permit extended uninterrupted operation, the power requirements of the operating system should have low current consumption.

Referring to FIG. 1*a*, there is illustrated a top view of a representative wash basin 10. The wash basin includes a bowl 12, a drain 14 and a spout 16 for discharging water. To sense or detect the presence of the hands of a user, a detection field 20 is established primarily only within bowl 12. As illustrated in FIG. 1*b*, the horizontal configuration of detection field 20 is generally round or ellipsoidal in cross section and conforming to a horizontal plane through bowl 12.

The vertical configuration of detection field 20 is best illustrated in FIGS. 2*a* and 2*b*. A sensor 22, responsive to a heat source within detection field 20, is located in rear wall 18 of bowl 12. The vertical parameter of detection field 20 is limited at the lower half by bowl 12. The upper limit of the detection field may be mechanically limited by a restrictor 24 used in conjunction with sensor 22. As particularly illustrated in FIG. 2*b*, the original detection field for sensor 22 would include the volumes represented by areas 1, 2 and 3. Area 3 is eliminated by bowl 12, which bowl defines the lower perimeter of area 2. Upper area 1 may be eliminated by restrictor 24 operating in conjunction with the sensor. Accordingly, the detection field to which sensor 22 is responsive is essentially limited by the space within bowl 12 and extending in rounded manner slightly upwardly therefrom.

Such limited detection field will prevent water flow during normal movement past wash basin 10 and essentially requires a user to place his hands or other body part essentially within bowl 12 of the water basin.

Referring to FIG. 3, there is illustrated a representation of the major components of the present invention which may be installed as original equipment or as retrofit equipment in a wash basin. Module 30 includes a heat sensor or infrared sensor 22 that may be penetrably mounted in rear wall 18 of a wash basin 20 (see FIG. 2*a*). For reasons discussed above, the parameters of the field within which sensor 22 will detect a heat source represented by a body part is limited to the volume essentially within the wash basin. The sensor produces an output signal and a module 30 may include an amplifier for amplifying the output signal. To establish a threshold of operation for sensor 22, a regulating device 32 may be incorporated. The circuit attendant the regulating device may be contained within module 30 and be connected to the regulating device via conductor 34. The regulating device permits establishment of a threshold temperature for the sensor to accommodate variations in ambient temperature. A module 36, interconnected with module 30 through an electrical conductor or cable 38, includes timing circuitry for generating a control signal to provide power to actuate a water valve controlling the water flow through spout 16. Circuitry for deactuating the water valve, along with a time delay to minimize false actuations, are also contained within module 36. Because a certain amount of power is required to deactuate or close the water valve, it is mandatory that sufficient power be available to perform this function. Accordingly, a fail safe circuit may be contained within module 36 to lock the water valve in the off or closed position when the source of power drops below a predetermined voltage (for example, 7.5 volts). A conductor 40 conveys electrical power to the water valve (not shown).

A characteristic of active detection systems is the transmission of a signal which is reflected from a triggering object to a receiver. Such transmission requires a substantial amount of power. A passive system is one in which a signal is received from the triggering element. For this reason, the power demands of a passive system are substantially less than that of an active system. Since the present invention is a passive system, and by careful circuit design, very little power is required for operation. For this reason, a conventional nine volt battery 42 may be used as a power supply. The battery is electrically connected to module 36 via a conventional clip 44 and electrical conductors 46.

Figure 4B:
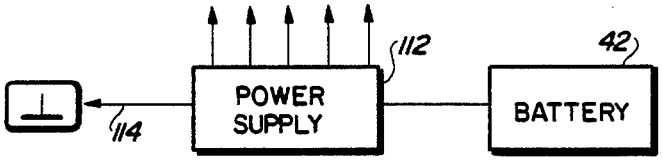
FIG. 4*b* is a block diagram illustrating the electrical power source for the circuit depicted in FIG. 4*a;*
Figure 4A:
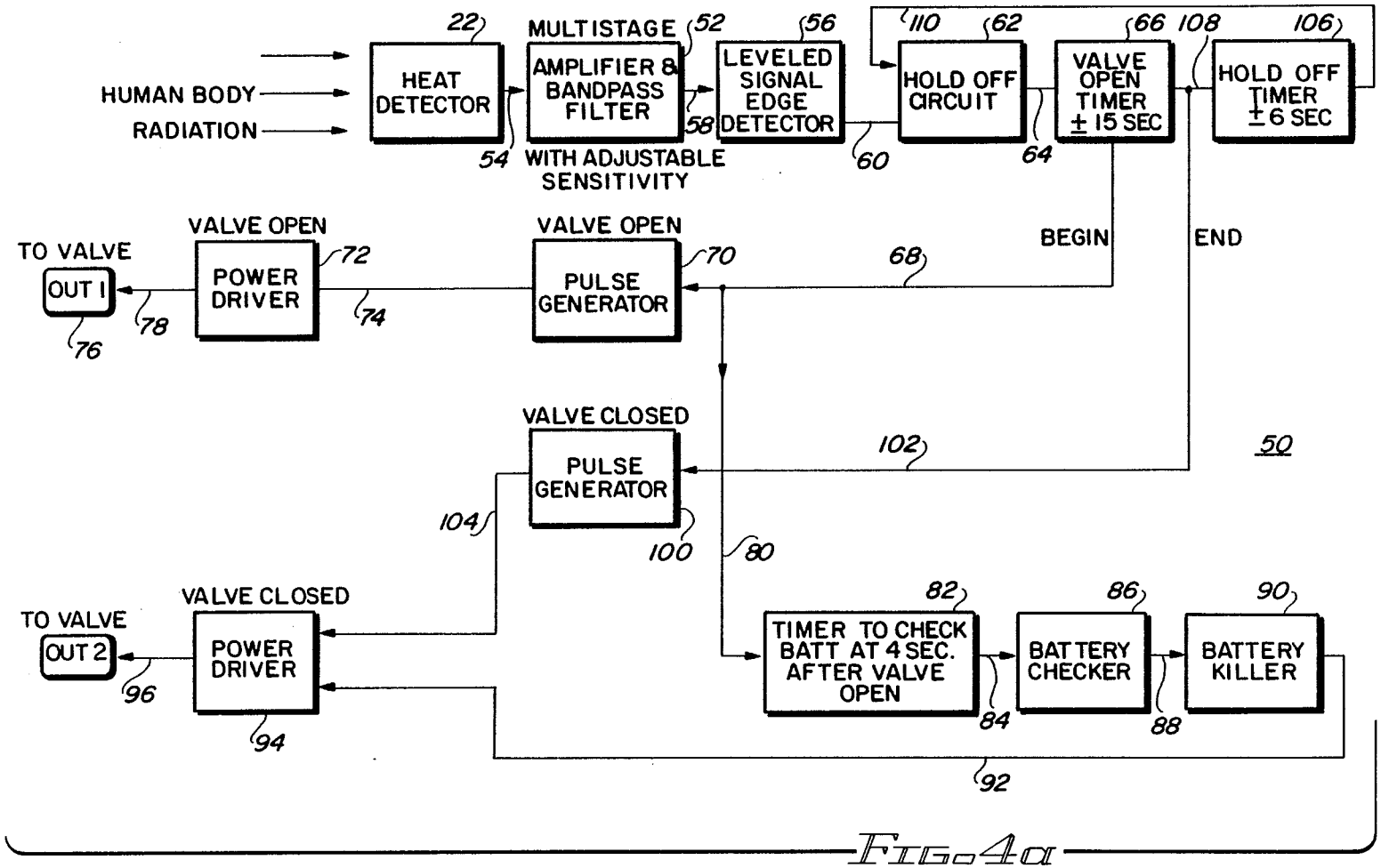
FIG. 4*a* is a block diagram of the detection circuit.
Figure 5:
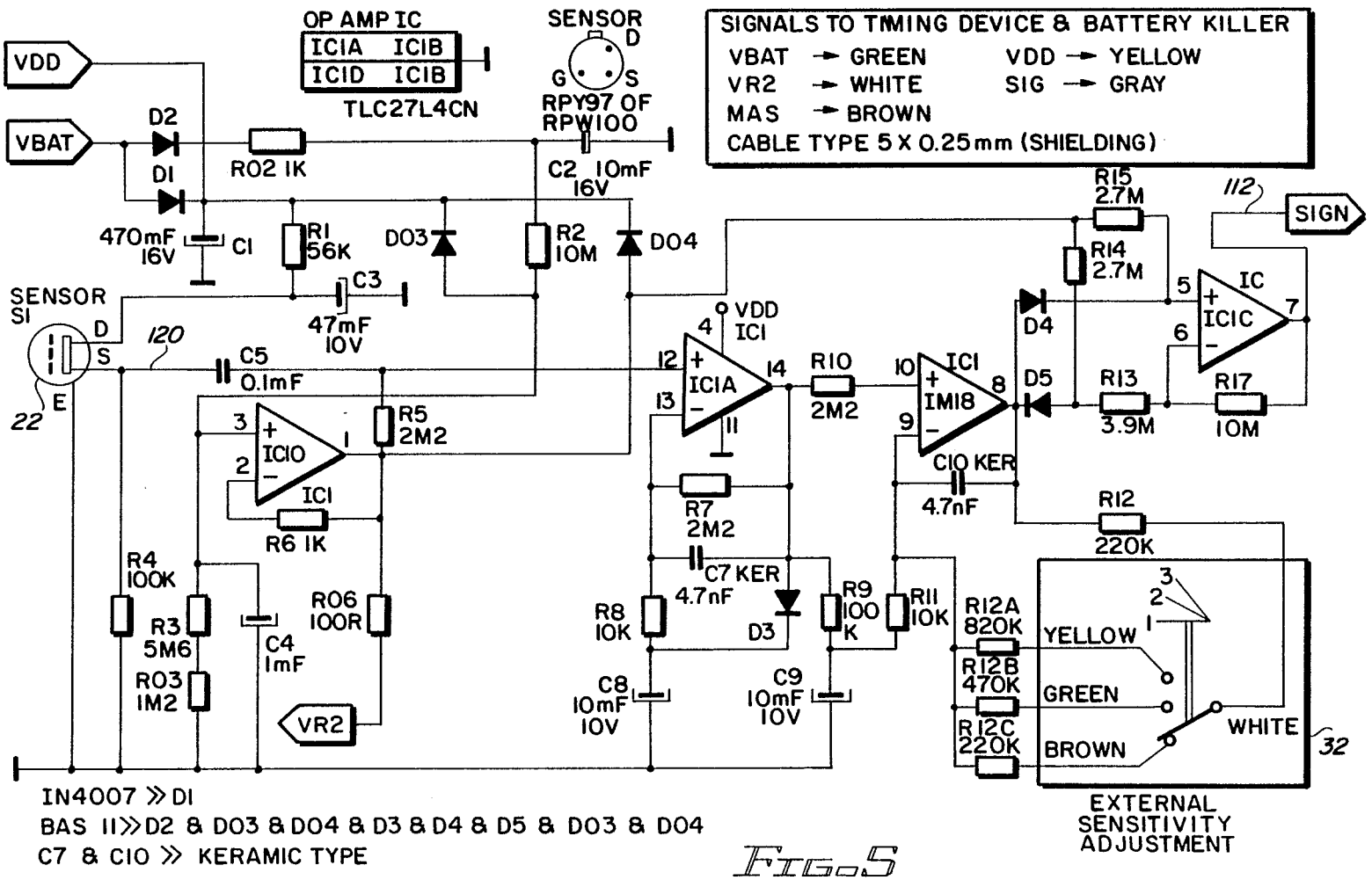
FIG. 5 illustrates the receiver and amplifier circuits of the detection system.

Referring to FIG. 4*a*, there is illustrated a block diagram of the circuit and operation of detection system 50. The heat detector or sensor 22 is a dual element pyro electric heat detector specifically intended for battery operated passive detection systems. It has differentially connected dual elements which provide immunity from background radiation and acoustic acoustic noise. The spectral response of the sensor is in the range of five to fifteen $\mu$m; this is the range of the wave length of the infrared rays emitted by a human as a result of body heat. The frequency range is 0.1 to 20 Hz; such low frequency range essentially eliminates any influence from ambient or expected acoustic noise sources. The quiescent power drain of the sensor is approximately 10 $\mu$A and represents a very low current drain. The dual elements are combined with a single impedance converting amplifier specially designed to require a low voltage power supply and has a low current consumption. An output signal is provided by the sensor only upon occurrence of an imbalance of radiation impinging upon the dual elements. More particularly, the sensor contains ceramic plates sensitive to radiant heat and serving as electric dipoles permanently polarized which change polarity only upon a sudden change in voltage potential across the electrodes resulting from a sudden change of temperature. Since the sensor is not sensitive to ambient temperature, but only to a sudden change of temperature, the sensor is self adjusting and accommodates slow changes in ambient temperature. More specifically, one of the ceramic plates reacts to the ambient temperature while the other plate is subjected to heat irradiating from the human body. This change in temperature registered by the plates generates an output signal.

The output signal generated by sensor 22 is transmitted to a multistage circuit 52 including an amplifier to amplify the low level output signal generated by the sensor and a band pass filter. Means may be incorporated to permit adjustment of the threshold of the output signal received from sensor 22 and amplified by use of regulating device 32 (see FIG. 3) or the like. A signal edge detector 56 detects positive and negative variations of a magnitude greater than a predetermined threshold of the signal received from multistage circuit 52 via conductor 58. The output of the signal edge detector is transmitted through conductor 60, hold off circuit 62 and conductor 64 to valve open timer 66 when the hold off circuit is not active.

The output of the valve open timer is transmitted via conductor 68 to pulse generator 70. On receipt of the output signal, the pulse generator will activate power driver 72 via conductor 74. The power driver will provide power to an electromagnetic valve, represented by numeral 76, to open the valve and permit water flow through spout 16. The output from valve open timer 66 is also transmitted via conductor 80 to a four second timer 82. After valve 76 has been open for approximately four seconds, timer 82 will transmit a signal via conductor 84 to a battery checker 86. The function of the battery checker is to determine whether the power supply (battery) is maintaining a voltage above a predetermined level during energization of valve 76. Power driver 94 and closure of the valve require a predetermined amount of electrical power. Such power level can be translated to a minimum acceptable voltage at the power supply or battery if the characteristics of the power supply or battery are known. In the event the voltage sensed is below the predetermined value, an output is provided via conductor 88 to a battery killer circuit 90. The function of the battery killer circuit is to generate a control signal for transmission via conductor 92 to power driver 94. On energization of power driver 94, an output signal is generated and transmitted via conductor 96 to close the water valve. This procedure will ensure that the water valve will not remain open due to a power drain or low voltage at the power supply.

Valve open timer 66 also determines the time during which the valve will remain open. On completion of this time period (nominally 20 seconds), a further output signal is generated and transmitted to pulse generator 100 via conductor 102. The pulse generator will provide a signal via conductor 104 to power driver 94 to close the valve. The second output signal is also transmitted to hold off timer 106 via conductor 108. The purpose of the hold off timer is to provide a delay of approximately six seconds before the valve can be opened again. Hold off timer 106 transmits a signal to hold off circuit 62 via conductor 110 to preempt or inhibit transmission of a signal via conductor 64 to valve open timer 66 prior to expiration of the delay period.

FIG. **4*b* provides a representation in block diagram form of battery 42 energizing a power supply bus 112 from which a plurality of conductors extend to various components of detection system 50. The power supply is grounded, as represented by conductor 114**.

FIGS. 5 through 8 illustrate the arrangement, identification of components and component values of circuitry represented by the block diagram illustrated in FIGS. **4*a* and 4*b*. Since a circuit designer of ordinary skill in the art could build and use these circuits as a result of the detailed information contained therein, a detailed description of the signal paths and functions of the various components need not be undertaken. Instead, certain features of these circuits will be highlighted in the discussion below. The output signal of sensor 22 (S1) appears on conductor 120. This output signal is detected and amplified by the operational amplifiers and a usable output signal is produced on conductor 122. Regulating device 32 (see also FIG. 3**) provides a trilevel sensitivity adjustment to accommodate for varying degrees of sensitivity desired. This is achieved by varying the feedback across operational amplifier IC1B.

Figure 6:
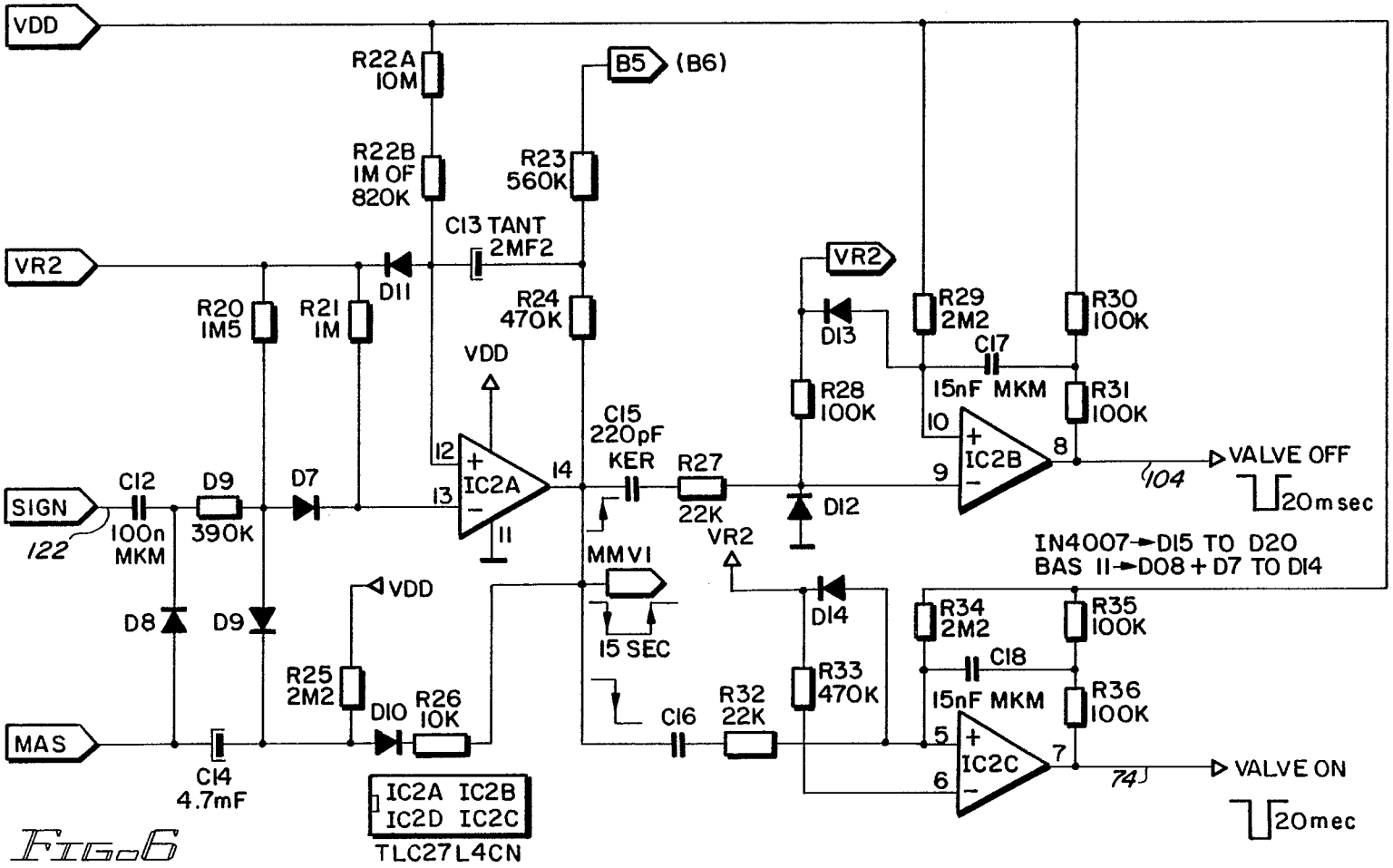
FIG. 6 illustrates the timer control of the detection system.

FIG. 6 illustrates the circuit for detecting the leading edge of the output signal on conductor 122, holdoff circuit 62, valve open timer 66 and pulse generators 70,100. The output of the pulse generators is transmitted via conductor 74,104 to power driver 72,94, respectively, illustrated in FIG. 7. Power applied via conductor 78 to valve 76 from power driver 72 will open the valve. Similarly, power provided on conductor 96 to valve 76 will close the valve.

Figure 8:
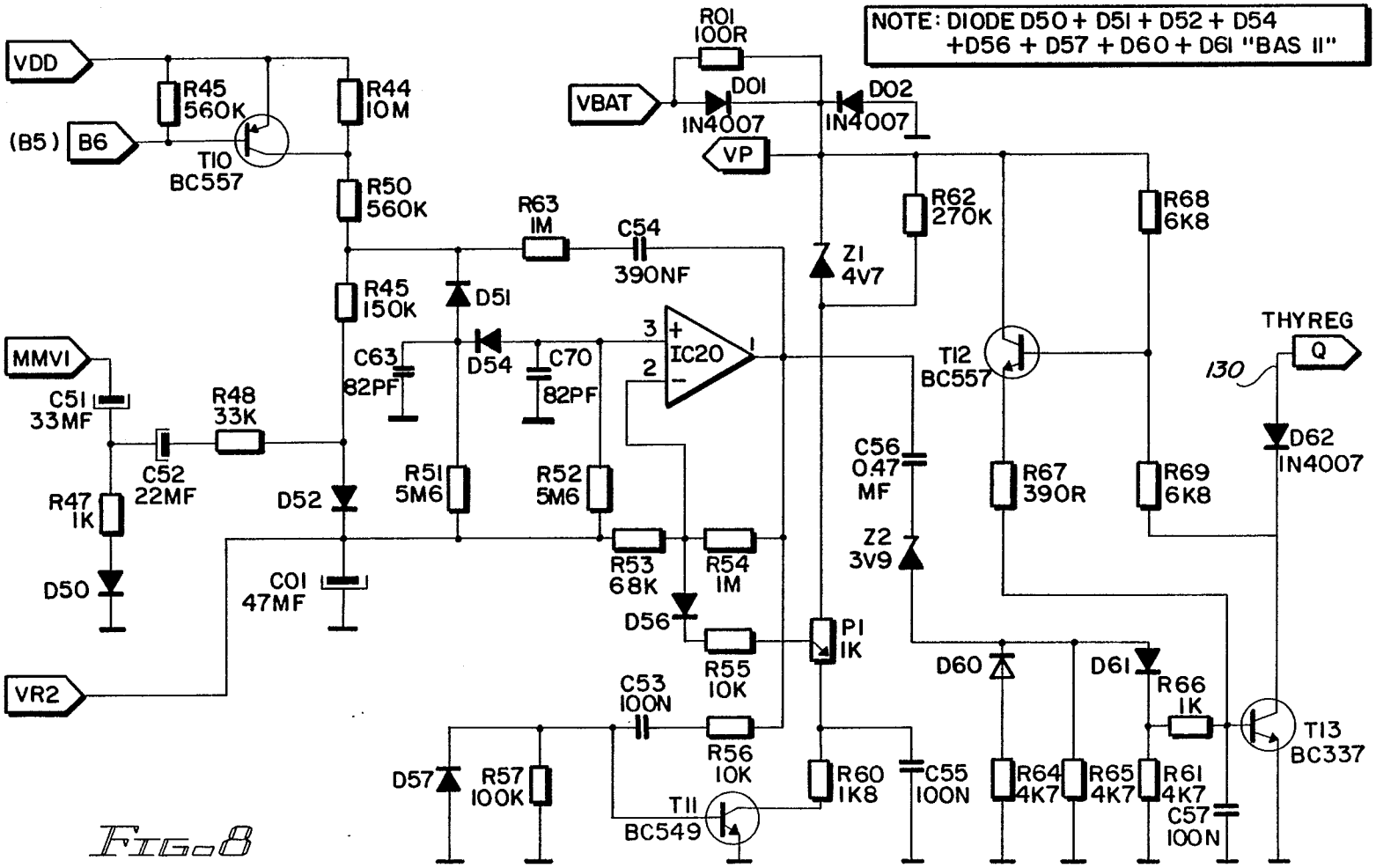
FIG. 8 illustrates the battery killer circuit of the detection system.

A signal appearing as output MMV1 in FIG. 6 is transmitted to the circuit shown in FIG. 8. This circuit performs the function of checking the voltage of the power supply (battery). Upon determining that the voltage of the power supply is below a predetermined limit, an output signal will appear on conductor 130. This signal is transmitted to the power output circuit illustrated in FIG. 7. An output signal on conductor 130 will cause transistor T2 to conduct and the resulting signal conveyed along conductor 96 to valve 76 will turn off the valve. Moreover, the valve will be maintained off until the battery is replaced.

A presently available nine volt Lithium battery has a capacity of 1.1 Ah which corresponds with 3,960 Asec. In the quiescent state, detection system 50 draws approximately 100 $\mu$A; which corresponds with 8.64 Asec. per day (100 $\mu$A $\times$ 86400 sec/day). By adding the current demands of the detection system during operation and the current drawn by the solenoid valve upon actuation, both of which are a function of the number of cycles per day, a table can be constructed to establish the useful life of the battery as a power supply. Such a table appears below:

| CYCLES/ DAY | QUIESC. CURRENT | OPER. CURRENT | SOLENOID | TOTAL | BATTERY LIFE |
|---|---|---|---|---|---|
| 40 | 8.64 Asec | 0.084 Asec | 0.48 Asec | 9.204 Asec | $\frac{3{,}960}{9.204}$ = 430 days |
| 60 | 8.64 Asec | 0.126 Asec | 0.72 Asec | 9.486 Asec | $\frac{3{,}960}{}$ = 417 days |

-continued

| CYCLES/ DAY | QUIESC. CURRENT | OPER. CURRENT | SOLENOID | TOTAL | BATTERY LIFE |
|---|---|---|---|---|---|
| 100 | 8.64 Asec | 0.21 Asec | 1.2 Asec | 10.05 Asec | $\frac{9.486}{10.05}$ 3,960 = 394 days |

It is therefore evident one can expect at least a year of use before replacement of the battery will be necessary.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A passive apparatus for controlling the operation of a fluid flow control valve in response to the presence of a human body part, said apparatus comprising in combination:

(a) a sensor for detecting heat irradiating from a human body part within a predetermined detection field and for producing an output signal in response to such detection;

(b) means for amplifying the output signal;

(c) means for opening the valve to permit fluid flow therethrough in response to the amplified signal;

(d) means for closing the valve after a predetermined time period;

(e) a low voltage power source for energizing said apparatus;

(f) means for determining the voltage of said power source while the valve is open;

(g) means for comparing the determined voltage with a predetermined voltage and for generating a control signal if the determined voltage is below the predetermined voltage; and (h) means for closing the valve in response to generation of the control signal.

2. The apparatus as set forth in claim 1 including means for preempting opening of the valve for a set time period subsequent to closing of the valve.

3. The apparatus as set forth in claim 1 including electrically responsive means for opening and closing the valve.

4. The apparatus as set forth in claim 3 wherein said electrically responsive means is a solenoid.

5. The apparatus as set forth in claim 1 wherein said sensor is a bipolar element having a first element responsive to the ambient temperature and a second element responsive to heat irradiated from the body part and including means for generating an output signal in response to a change in temperature between the first and second elements.

6. The apparatus as set forth in claim 1 wherein said power source is a nine volt battery.

7. The apparatus as set forth in claim 1 including means for regulating the sensitivity of said sensor.

8. The apparatus as set forth in claim 7 wherein said regulating means includes three settings.

9. The apparatus as set forth in claim 1 including a wash basin and means for mounting said sensor with said wash basin.

10. The apparatus as set forth in claim 9 wherein said wash basin includes a bowl for defining at least a part of the detection field.

11. The apparatus as set forth in claim 10 wherein said wash basin includes a spout in fluid communication with the valve, whereby operation of the valve regulates fluid flow through said spout into said wash basin.

12. The apparatus as set forth in claim 9 wherein said wash basin includes a rear wall and wherein said sensor is mounted in said rear wall.

13. The apparatus as set forth in claim 12 wherein said wash basin includes a spout in fluid communication with the valve, whereby operation of the valve regulates fluid flow through said spout into said wash basin.

14. The apparatus as set forth in claim 13 including a restrictor associated with said sensor for defining at least a part of the detection field.

15. A passive method for controlling the operation of a fluid flow control valve in response to the presence of a human body part, said method comprising the steps of:

(a) detecting heat irradiating from a human body part placed within a predetermined detection field and producing an output signal in response to said step of detecting;

(b) amplifying the output signal;

(c) opening the valve to permit fluid flow therethrough in response to the amplified signal;

(d) closing the valve after a predetermined time period;

(e) energizing the control and operation of the valve with a low voltage power source;

(f) determining the voltage of the power source while the valve is open;

(g) comparing the voltage determined during said step of determining with a predetermined voltage and generating a control signal if the determined voltage is below the predetermined voltage; and (h) closing the valve in response to generation of the control signal.

16. The method as set forth in claim 15 wherein the valve is part of a wash basin for controlling the flow of water through a spout feeding the wash basin and wherein said step of opening includes the step of evacuating water through the spout into the bowl of the wash basin.

17. The method as set forth in claim 15 including the step of regulating the threshold of the output signal.

18. The method as set forth in claim 15 wherein said step of detecting includes the step of detecting radiation in a spectral range of 5 to 15 $\mu$m.

19. The method as set forth in claim 15 wherein said step of detecting is performed in the frequency range of 0.1 to 20 Hz.

20. The method as set forth in claim 19 wherein said step of detecting includes the step of detecting radiation in a spectral range of 5 to 15 $\mu$m.

* * * * *